US012604961B2

(12) United States Patent
Poggioli

(10) Patent No.: US 12,604,961 B2
(45) Date of Patent: Apr. 21, 2026

(54) HAIR EXTENDING NYLON SYSTEM

(71) Applicant: Yvonne Delana Poggioli, Louisville, KY (US)

(72) Inventor: Yvonne Delana Poggioli, Louisville, KY (US)

( * ) Notice: Subject to any disclaimer, the term of this patent is extended or adjusted under 35 U.S.C. 154(b) by 188 days.

(21) Appl. No.: 18/518,992

(22) Filed: Nov. 26, 2023

(65) Prior Publication Data

US 2025/0169586 A1 May 29, 2025

(51) Int. Cl.
*A45D 2/00* (2006.01)
*A45D 8/00* (2006.01)

(52) U.S. Cl.
CPC ..... *A45D 2/001* (2013.01); *A45D 8/00* (2013.01)

(58) Field of Classification Search
CPC ..... A45D 2/00; A45D 2/001; A45D 2/007; A45D 2/02; A45D 2/08; A45D 2/10; A45D 2/122; A45D 2/125; A45D 2/127; A45D 2/146; A45D 2002/025; A45D 7/00; A45D 2007/002; A45D 8/00; A45D 8/001; A45D 8/002; A45D 8/004; A45D 8/006; A45D 8/16; A45D 8/34; A45D 8/40

See application file for complete search history.

(56) References Cited

U.S. PATENT DOCUMENTS

| | | | | | |
|---|---|---|---|---|---|
| 3,295,535 | A * | 1/1967 | Amato | A45D 19/012 | 132/212 |
| 5,730,161 | A * | 3/1998 | Kohanek | A45D 8/34 | 132/273 |
| 5,810,022 | A * | 9/1998 | Reynolds | A45D 8/34 | 132/273 |
| 9,439,489 | B1 * | 9/2016 | Townsell | A45D 8/34 | |
| 2008/0149130 | A1 * | 6/2008 | Brown | A45D 8/34 | 132/279 |
| 2008/0202547 | A1 * | 8/2008 | Blye | A45D 8/34 | 132/270 |
| 2025/0169588 | A1 * | 5/2025 | Gilmore | A45D 7/00 | |

* cited by examiner

*Primary Examiner* — Rachel R Steitz
*Assistant Examiner* — Karim Asqiriba

(57) ABSTRACT

Soft nylon strips that can be braided around the hair after it has been parted into sections. After the hair is braided, the braid is inserted into the nylon sock. Pull the hair behind the head and tie the braids together. If you can't reach, you can pin the braid to the head using a bobby pin. You can leave the cords in overnight. The longer the strips are left in, the more the hair is stretched.

2 Claims, 7 Drawing Sheets

HAIR EXTENDING NYLON SYSTEM

BACKGROUND OF THE INVENTION

The problem is African, or extremely curly hair shrinks when it gets wet.

SUMMARY OF THE INVENTION

This invention safely stretches delicate hair, so that you can see its length. Allow you to diversify the style. Extends the curls, so you can see the length of the hair, and makes the hair easier to style and manage.

BRIEF DESCRIPTION OF THE DRAWINGS

Drawing One: Shows a picture of the nylon strip on one side, and a nylon sock on the other.

Drawing Two: Illustrates a woman with a short afro, prior to using the nylons hair extenders.

Figure 1:
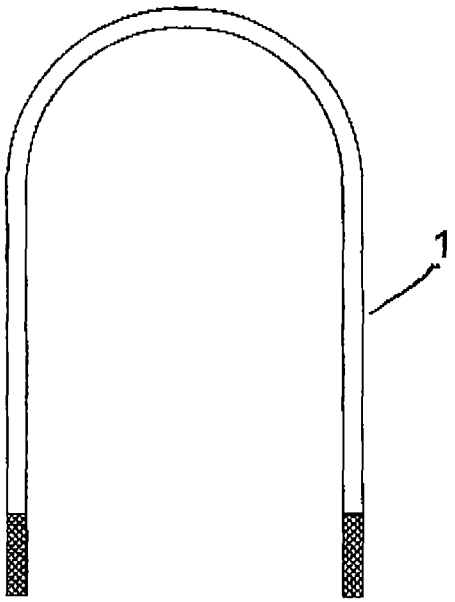
Figure 2:
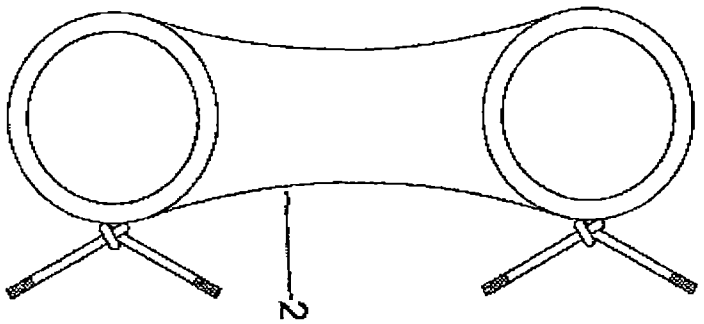
Figure 3:
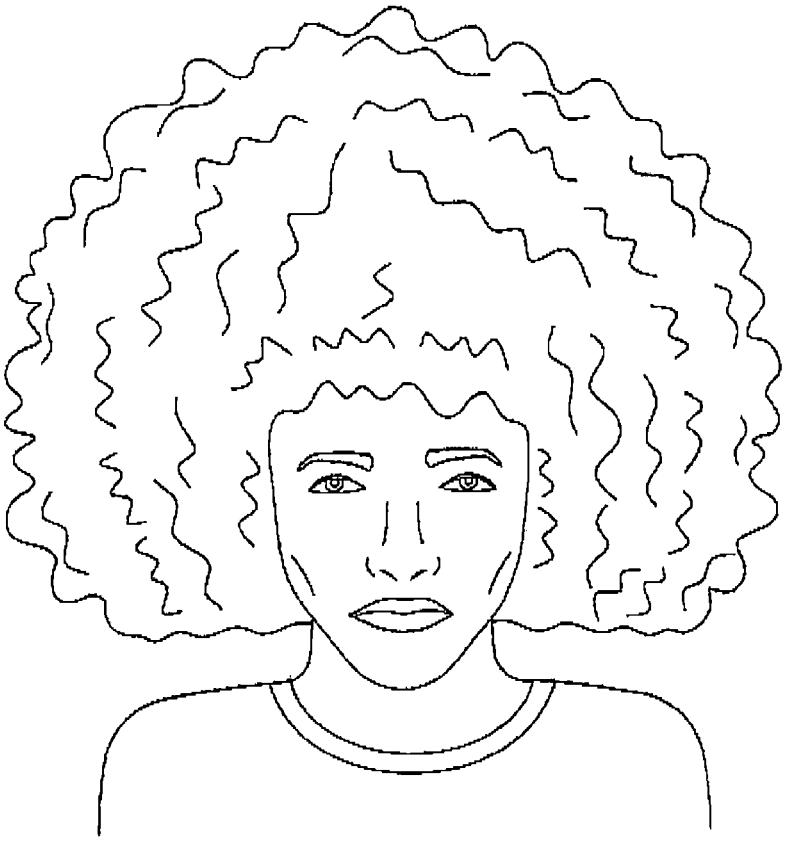
Figure 4:
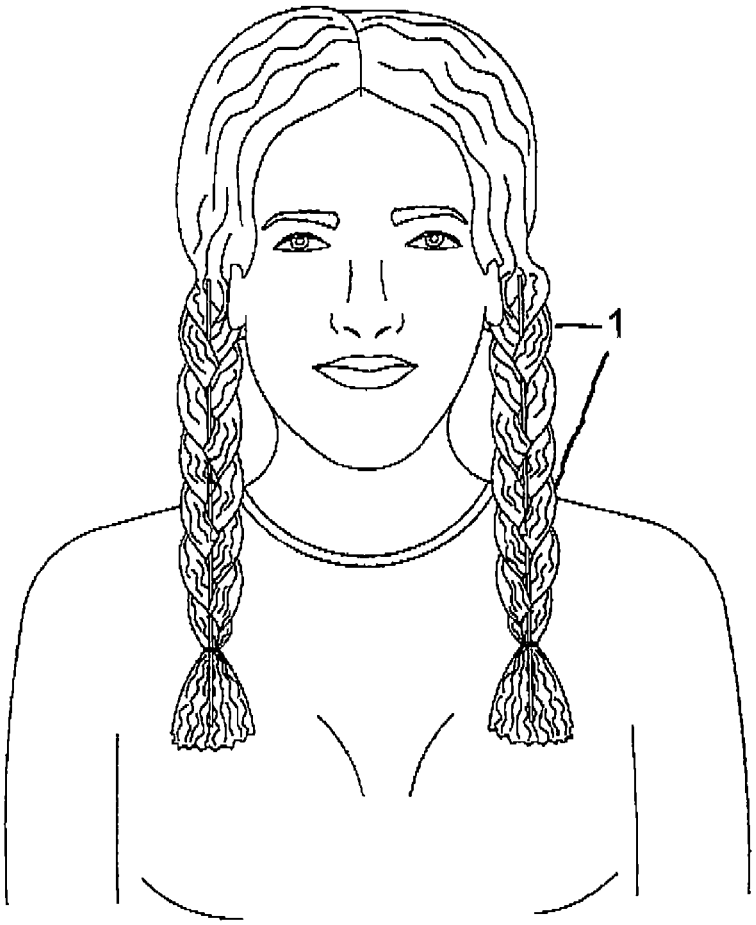
Figure 5:
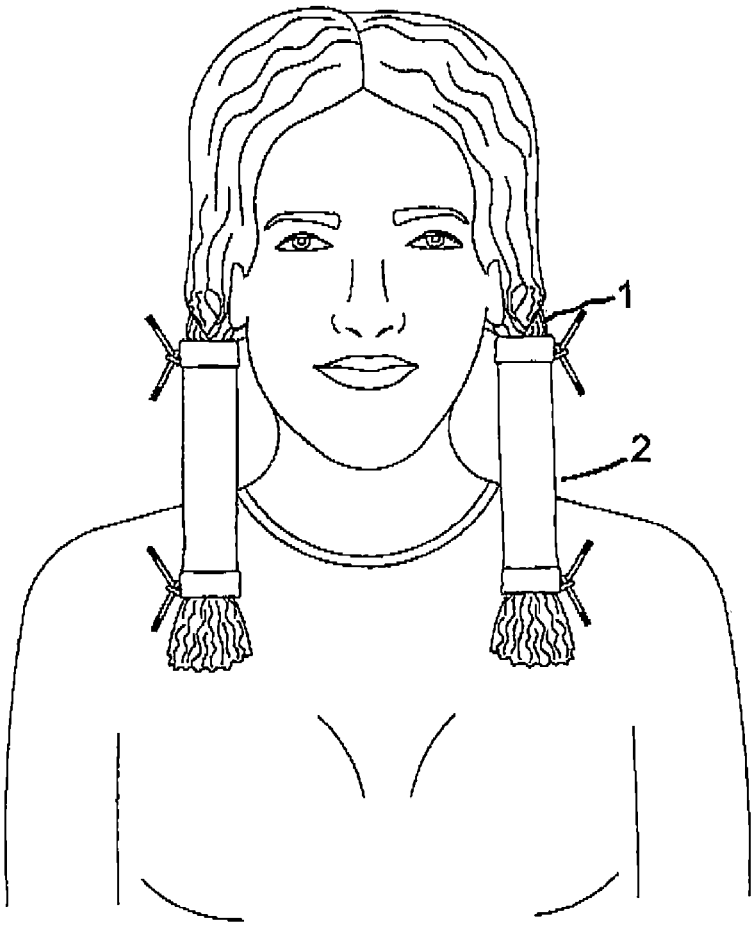
Figure 6:
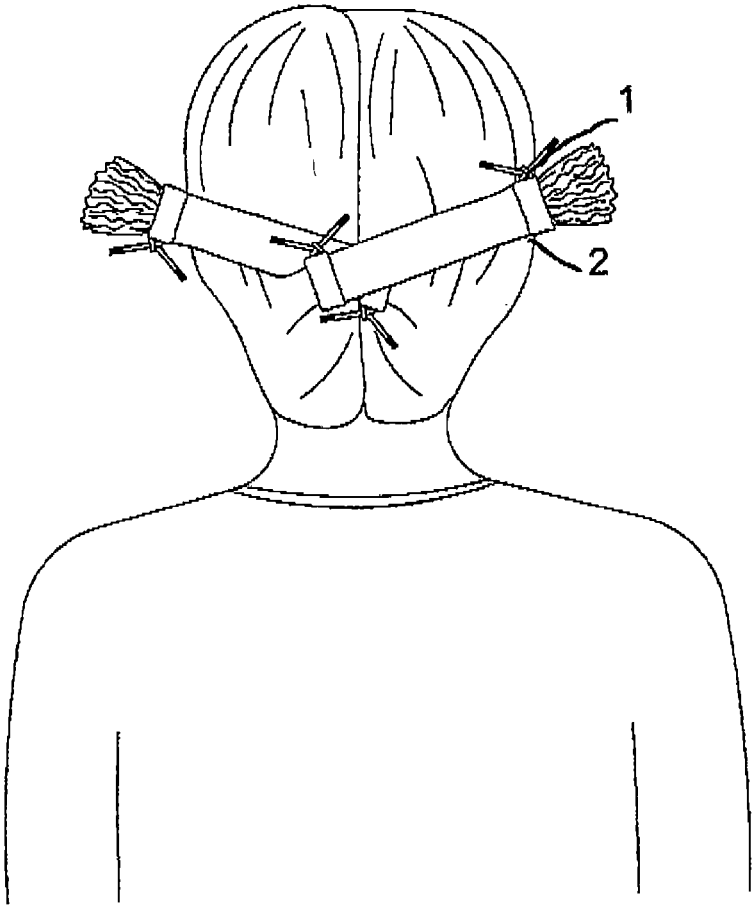
Figure 7:
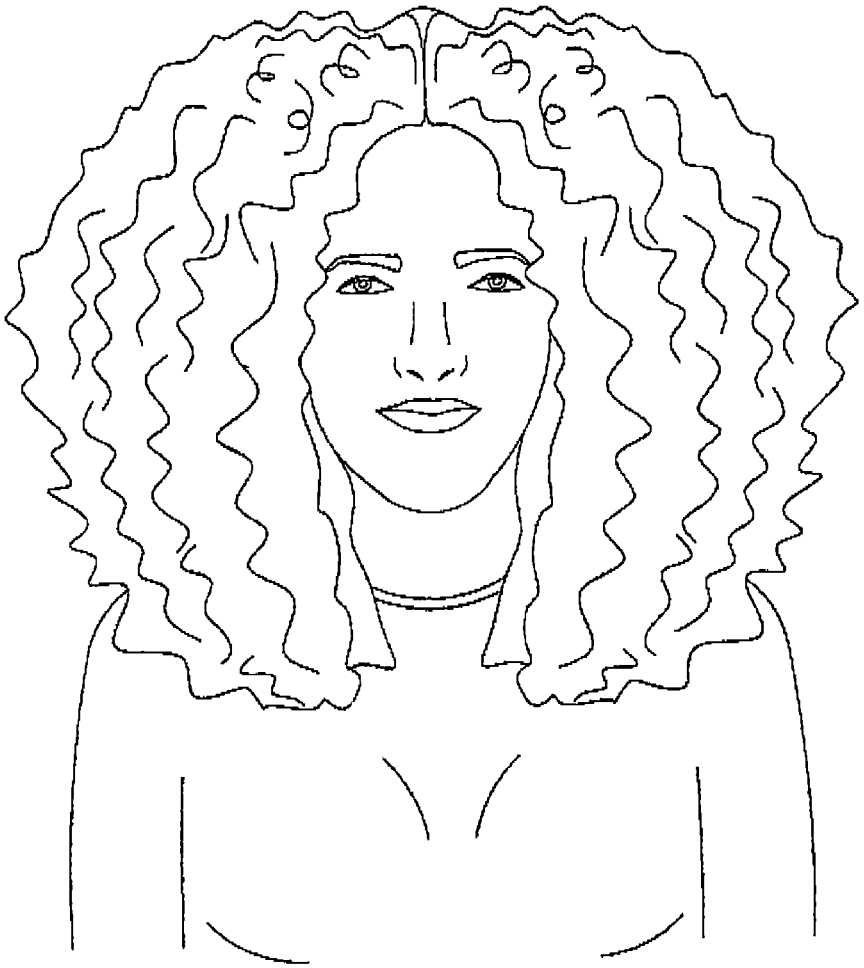

Drawing Three: Shows the nylon strip after it is braided around the hair, into two ponytails.

Drawing Four: Shows both braids after they are covered by a nylon sock to prevent frizziness.

Drawing Five: Shows the braids being tied together behind the head, to extend the hair for maximum stretching.

Drawing Six: Shows the end results of the stretched hair after the extenders are removed.

DETAILED DESCRIPTION OF THE INVENTION

A nylon cord is used to form a braid, wrapping it around the hair to form a ponytail. Once the hair is braided, the nylon sock can be tightened at the root of the braid, and at the tip, to cover the braid, and prevent the hair from becoming frizzy.

The invention claimed is:

1. A method of stretching curly or coily hair to reduce shrinkage and show the hair's length, consisting of:

1. Dividing a section of the hair into at least one braid or twist;
2. Providing a flexible nylon cord and a tubular nylon sock having a length between a first and second openings; wherein the first and second openings are positioned at opposite ends of the nylon sock, and fastening elements positioned adjacent to the first and second openings of the nylon sock;
3. threading the nylon cord through the at least one braid or twist of the section of the hair;
4. inserting the nylon cord with the at least one braid or twist of the section of the hair through the first and second openings of the nylon sock through a central portion, along the length, of the nylon sock;
5. applying tension to the at least one braid or twist by pulling on the nylon cord and fastening the nylon sock around the at least one braid or twist using the fastening elements;
6. maintaining the tension for a predetermined period of time to stretch the hair before removing the nylon sock and cord.

2. A hair stretching device, the device consisting of:

a flexible nylon cord;

a tubular nylon sock having a length between a first and a second opening positioned at opposite ends of the tubular nylon sock;

fastening elements located adjacent to the first and second openings of the nylon sock, wherein the nylon cord is threaded through a braid or twist of the hair and inserted through the first and second openings along the length of the tubular nylon sock, and wherein tension is applied to the hair by securing the nylon sock around the braid or twist using the fastening elements, wherein the device is configured to maintain the hair in a stretched state over a period of time.

* * * * *